US008449292B2

(12) United States Patent
Knoch et al.

(10) Patent No.: US 8,449,292 B2
(45) Date of Patent: May 28, 2013

(54) ROTARY FURNACE BURNER

(75) Inventors: Alexander Knoch, Lohmar (DE); Ernst Schröder, Büllingen (BE); Karin Kluthe, Brühl (DE); Wilhelm Wenzel, Seigburg (DE); Giovanni Loggia, Köln (DE)

(73) Assignee: KHD Humboldt Wedag GmbH, Cologne (DE)

( * ) Notice: Subject to any disclaimer, the term of this patent is extended or adjusted under 35 U.S.C. 154(b) by 1417 days.

(21) Appl. No.: 12/089,719

(22) PCT Filed: Nov. 8, 2006

(86) PCT No.: PCT/EP2006/010671
§ 371 (c)(1),
(2), (4) Date: Apr. 10, 2008

(87) PCT Pub. No.: WO2007/054271
PCT Pub. Date: May 18, 2007

(65) Prior Publication Data

US 2008/0213714 A1 Sep. 4, 2008

(30) Foreign Application Priority Data

Nov. 11, 2005 (DE) ..... 10 2005 053 819

(51) Int. Cl.
*F23C 7/00* (2006.01)
*F23D 17/00* (2006.01)
*F23D 3/00* (2006.01)

(52) U.S. Cl.
USPC ..... 431/284; 431/195; 431/200; 431/201

(58) Field of Classification Search
USPC ..... 431/284, 285, 195–201
See application file for complete search history.

(56) References Cited

U.S. PATENT DOCUMENTS

| | | | | |
|---|---|---|---|---|
| 4,566,633 | A * | 1/1986 | Rinkewich | 239/237 |
| 2003/0157451 | A1 * | 8/2003 | McCabe | 431/187 |
| 2007/0042308 | A1 * | 2/2007 | Schmidt et al. | 431/353 |

FOREIGN PATENT DOCUMENTS

| | | | |
|---|---|---|---|
| AU | 10 2004 010063 | | 9/2005 |
| DE | 43 19 363 | | 12/1994 |
| EP | 0 650 012 | | 4/1995 |
| EP | 0 642 645 | | 6/1997 |
| WO | WO 9421963 | A1 * | 9/1994 |

* cited by examiner

OTHER PUBLICATIONS

"Innovative Burning," International Cement Review Nov. 2000, p. 55-57.*

*Primary Examiner* — Thomas Denion
*Assistant Examiner* — Brian Inacay
(74) *Attorney, Agent, or Firm* — Greer, Burns & Crain, Ltd.

(57) ABSTRACT

A rotary kiln burner particularly for fine-grained solid fuels such as coal dust, with jet air nozzles which can be adjusted easily and effectively during operation of the kiln in order to change the divergence angle of the high-speed jet air streams to change the flame shape and optimize the combustion. The jet air nozzles are attached with the nozzle openings divergent to the burner axis at the end of jet air pipes. The nozzle openings are arranged around the burner axis, with the axes parallel, with the jet air pipes arranged inside an annular cooling air space surrounding the coal dust channel and enclosed on the outside by the burner housing pipe. The nozzle openings are mounted so that they can rotate around the jet air pipe axes, so that on turning the jet air pipes at the cold end of the burner lance, the divergence of the high-speed jet air streams, and thus the angle of the jet air flow angle of the jet air flow cone angle of the jet air flow cone in relation to the coal dust cone, can be changed and adjusted.

14 Claims, 2 Drawing Sheets

10
11
12
13
14
15
16
17
18
19
20
21
22
II

ROTARY FURNACE BURNER

BACKGROUND OF THE INVENTION

The invention concerns a burner for a rotary tubular kiln with an annular channel arranged within the burner housing pipe for the pneumatic transport and blowing out of fine-grained solid fuel through an annular gap nozzle, and with a number of jet air nozzles arranged concentrically around the circumference of the annular gap nozzle with nozzle openings divergent to the burner axis, through which combustion air is emitted, divided into a large number of separate, individual high-speed primary air jets.

Common rotary kiln burners are mostly designed as so-called three-channel burners (e.g. DE 43 19 363 A1), in which a pneumatically transportable solid fuel such as coal dust flows through the central burner channel, is emitted through an annular gap nozzle, and in which the coal dust emitted at a divergent angle in the form of a cone jacket is surrounded radially on both the inside and outside with primary air as the combustion air. The primary air channel located radially within the coal dust channel has at its mouth a spin-generator, so that the primary air emitted is given a rotation component, and is also referred to as twist, swirl or radial air. Common spin-generators are generally not adjustable, at least not when the rotary tubular kiln is in operation.

The combustion air of the rotary kiln burner radially outside the coal dust, also referred to as jet air, is divided by means of a number of individual nozzles arranged in the annular jet air channel into a number of individual high-speed primary air jets, which produce a low-pressure region in their vicinity, i.e., the many high-speed primary air jets act as driving jets in accordance with the injector principle, by means of which the large mass of practically stationary secondary air surrounding the rotary kiln burner, at a temperature of around 1,000° C., is drawn in in the direction of the core of the burner flame, where intensive mixing of the hot secondary air with the coal dust emerging from the annular gap nozzle takes place, which should be burnt quickly and completely by forming an assisted, short hot flame. For the purposes of adjustment of the divergence angle of the jet air streams, the cylindrical nozzle bodies with the nozzle holes set at an angle to the nozzle axis, can be individually turned, although not when the rotary kiln is in operation, so that the optimum coal dust-jet air mixture or flame shape cannot be adjusted when the kiln is in operation by adjusting the divergence angle of the jet air streams.

EP 0 642 645 B1 describes a rotary kiln burner in whose primary air channel flexible metallic air hoses with their nozzles are arranged around the circumference, and whose air flow direction can be set from axial to radial by means of turning the complete air hose assembly consisting of the flexible air hoses with their air outlet nozzles at an angle to the burner axis in order to increase the spring component of the radial air. Apart from the fact that this known spin-imparting device for a rotary kiln burner is comparatively complicated, this known design enables only the parallel outflow of fuel and primary air, even if the primary air is given a spin component. With this known air hose system, it is not possible to set or adjust a cone-shaped divergence angle of the primary air, i.e., to make the primary air emerge as a conical envelope with such a divergence angle as to ensure the optimum mixing of the fuel cone with the primary air cone with the greatest possible flame turbulence.

SUMMARY OF THE INVENTION

The invention is therefore based on the task of developing a rotary kiln burner specially for fine-grained solid fuels with jet air nozzles, which for the purposes of changing the divergence angle of the jet air streams and also in reaction to different types of fuels and/or resulting flame shapes, can be easily and yet effectively adjusted when the rotary kiln is in operation.

In the rotary kiln burner described by the invention, the jet air nozzles with the nozzle openings diverging from the burner axis are attached to the end of jet air pipes, which are arranged with parallel axes around the burner axis, within a cooling air channel surrounding the solid fuel channel, and enclosed on the outside by the burner housing pipe. The jet air pipes are thereby mounted in the cooling air channel so that they can turn, with the device for rotary adjustment of the jet air pipes arranged at the cold end of the burner lance. This makes it possible, depending on the setting of the jet air pipes and their attached jet air nozzles to have the jet air streams emerge divergent to, radiantly, or convergent with the burner axis, thereby enabling the divergence angle of the jet air streams to be set so that the jet air cone meets the fuel cone in the optimum way for the greatest possible flame turbulence, and enabling the adjustment and setting of the flame shape of the rotary kiln burner during operation of the kiln.

This also results in a compact design of the rotary kiln burner described by the invention due to the fact that the adjustable jet air pipes are located in the outer annular cooling air channel of the burner.

The mounting points of the individual jet air pipes are held in two spaced flange rings of the burner housing pipe. In accordance with a further feature of the invention, the annular space between the spaced flange rings within the burner housing pipe equipped with a jet air feed pipe can also be designed as a flow chamber, from which the jet air supplied flows through holes in the jet air pipes into the pipes themselves and then out through the jet air nozzles. As a variant to this design, flexible hoses for jet air supply to the jet air pipes can also be connected to the jet air pipes, which can be turned either individually or together around their longitudinal axes, at their outer ends away from the jet air nozzles.

As a device for rotary adjustment of the jet air pipes, these can be fitted for example at the outer ends with pinions, which engage in a ring or belt with internal teeth.

BRIEF DESCRIPTION OF THE DRAWINGS

The invention and its further features and benefits are described in greater detail by means of the design examples shown in schematic form in the figures.

These show.

DETAILED DESCRIPTION OF THE PREFERRED EMBODIMENTS

Figures 1, 2, 3:
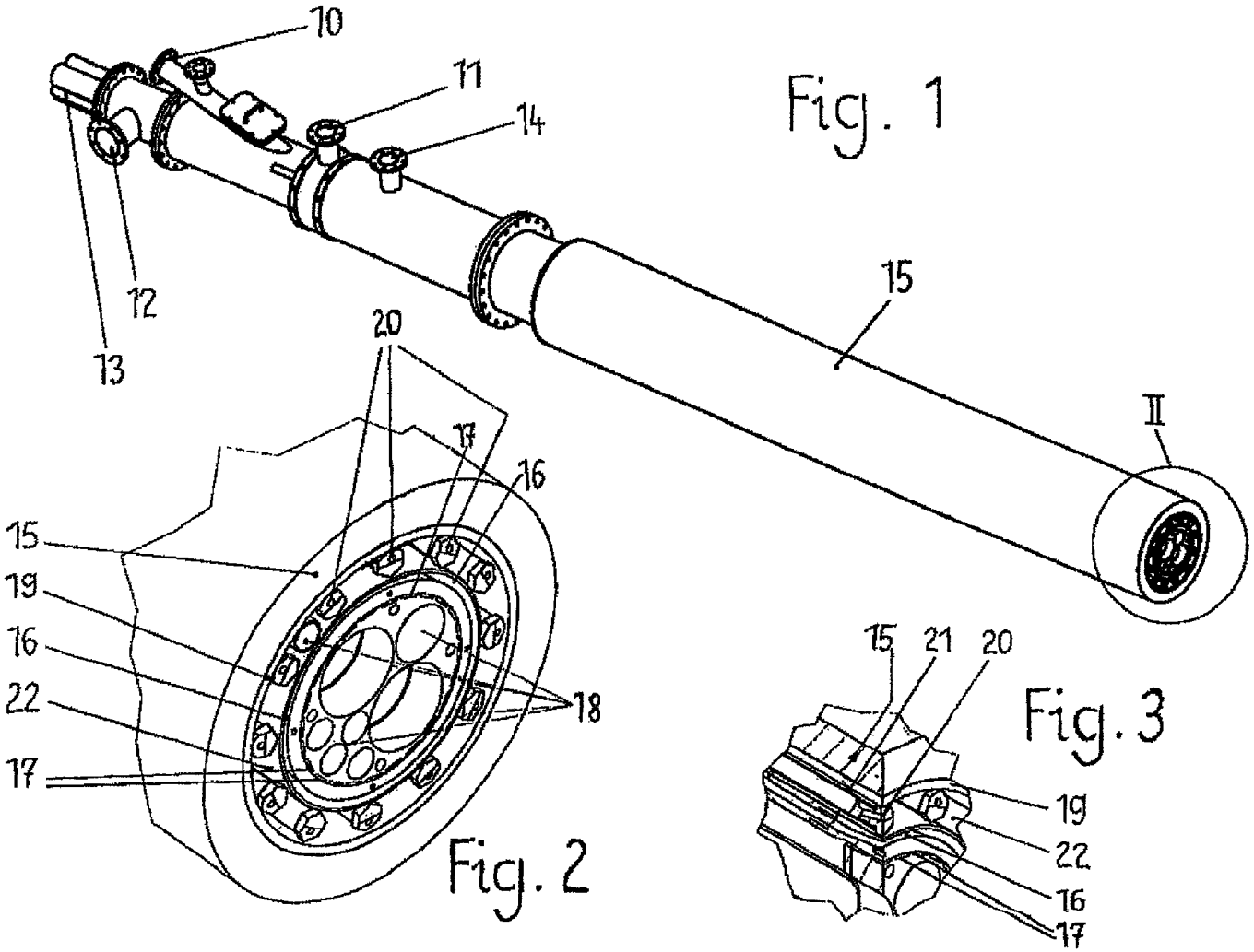
FIG. 1: Perspective view of the rotary kiln burner described by the invention as a complete burner lance.
FIG. 2: Enlarged perspective view (Detail II of FIG. 1) of the burner mouth.
FIG. 3: Further enlarged perspective view of a detail from FIG. 2.

FIG. 1 shows the complete burner lance with pipe (10) for supply of coal dust (11), for supply of jet air (12), for the supply of spin air (13), for the possible supply of alternative fuels and (14) for supply of cooling air for interior cooling of the burner housing pipe (19), which is armoured on the outside with a fireproof compound (15). The fuels supplied burn after emerging from the burner mouth and forming a flame at the right end of the burner lance in the rotary tubular kiln.

Initially explained by means of FIG. 2, the rotary kiln burner described by the invention is a three-channel burner with an annular channel for the pneumatic transport of fine-grained solid fuel, such as coal dust, which flows through an annular gap nozzle (16) at a slightly outwardly diverging angle. The coal dust channel is concentrically surrounded radially on the inside and outside by a combustion air channel, whose combustion air flows provide the primary air for the burner. The primary air channel arranged concentrically within the coal dust channel is equipped at its mouth with a spin-generator (17), e.g., spin slots, so that this radial inner primary air channel is also referred to as the spin-air channel. Ignition burners, as well as the mouths (18) for the combustion of alternative fuels (13) can also be arranged in the center of the burner mouth. The burner housing pipe (19), is protected in the forward area of the lance by the applied fireproof compound (15).

The radial outer primary air, i.e., the supplied jet air (11) emerges at high speed from individual jet air nozzles (20) arranged around the circumference of the burner mouth in the form of jets, e.g., 16 in number, of which jet air nozzle (20), with its nozzle bore divergent to the burner axis, can be seen in the detail view of FIG. 3. The high-speed jet air nozzles, which are able to draw in as much as possible of the hot secondary air at around 1,000° C. surrounding the rotary kiln burner in the rotary tubular kiln into the core of the burner flame for the purposes of rapid and complete coal dust combustion, should meet the fuel cone at the optimum point for achieving the greatest flame turbulence.

In accordance with the invention, the jet air nozzles (20) with their nozzle openings divergent to the burner axis, are attached at the end of (for example) 16 jet air pipes (21), which are arranged with parallel axes around the burner axis, within an annular cooling air channel (22) surrounding the coal dust channel and enclosed on the outside by the burner housing pipe (19), into which cooling air flows through the connecting pipe (14) of the burner housing pipe (19), and flows out again at the burner mouth in the area between the neighboring jet air nozzles (20), where the cooling air heated up in the burner lance then makes up part of the primary air.

Figure 4:
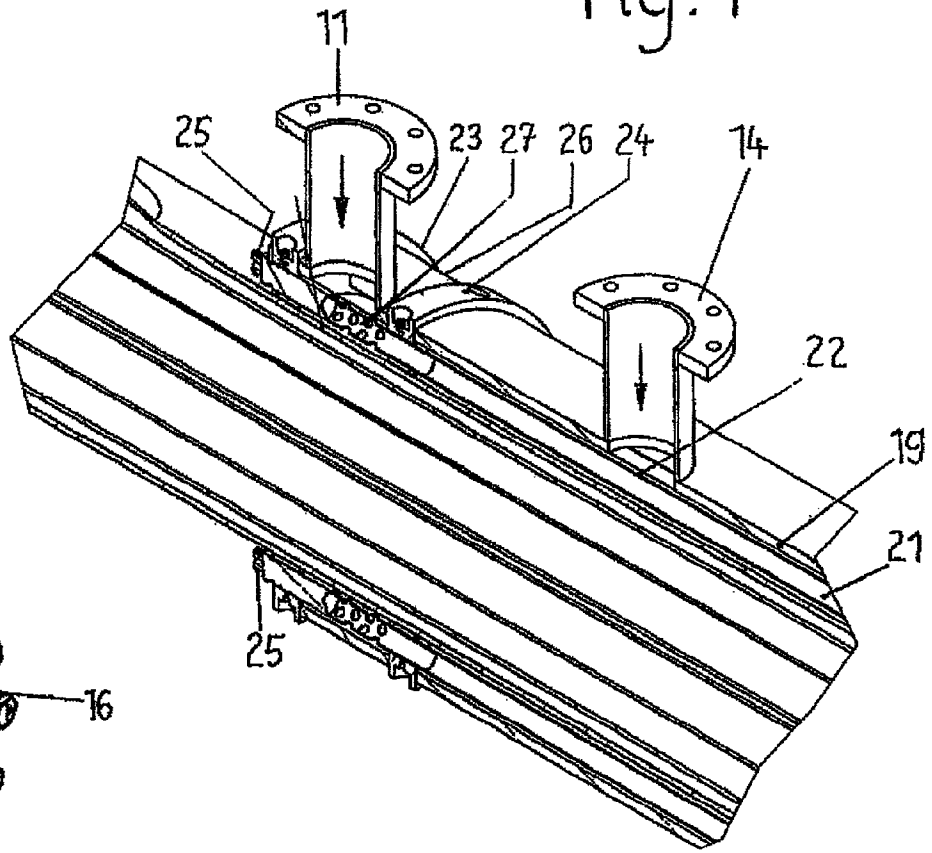
FIG. 4: Axial, sectional view through the rotary kiln burner showing the rotating mounting of the individual jet air streams pipes.

In the cooling air channel (22), the jet air pipes (21) distributed around the circumference are mounted so that they can rotate around their jet air pipe axes. As shown in FIG. 4, the rotating mounting points of the jet air pipes (21) can be held in two spaced flange rings (23, 24) of the burner housing pipe (19). The device for rotary adjustment of the jet air pipes is arranged outside the burner housing pipe (19) at the cold end of the burner lance, or at the left end of the lance in the design example. The example shows that the jet air pipes (21) can be equipped with pinions (25) at their outer ends, which are closed in the design example, which engage in a ring or belt or linked chain with internal teeth (not shown). By turning the adjusting ring or belt, all jet air pipes (21) with their jet air nozzles (20), can then be turned in synchronization, so that the divergence angle of the jet air stream cone can then be changed during operation of the kiln in order to adjust the burner flame and the fuel consumption.

In the design example shown in FIG. 4, the annular space between the spaced flange rings (23, 24) within the burner housing pipe (19) equipped with a jet air feed pipe (11) is designed as a flow chamber, from which the jet air supplied flows through holes (27) in the jet air pipes (21) into the pipes themselves and then out through the jet air nozzles (20). The flow chamber (26) is sealed in the flange rings (23, 24) by means of annular seals, with preference to the outside. A certain leakage flow rate of jet air can be accepted in the invention without problems because the leakage flow of jet air then forms part of the cooling air which is used in any event within the annular cooling air channel (22).

As an alternative to the design variant shown in FIG. 4, it would also be possible to connect flexible hoses for jet air supply to the jet air pipes (21) at their outer (left) ends away from the jet air nozzles (20), with the flexible feed hoses allowing the rotation of the individual jet air pipes by a certain angle.

Figure 5:
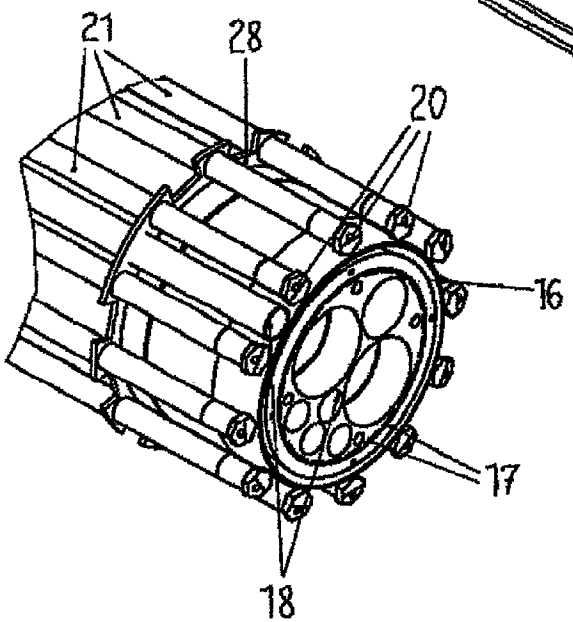
FIG. 5: Perspective view of the burner mouth, similar to FIG. 2, in which the burner housing pipe with protective jacket has been omitted.

In FIG. 5, it can be seen that in the annular cooling air space between the burner housing pipe (19) omitted in this Figure and the coal dust pipe with the annular gap nozzle (16), in which the jet air pipes (21) with their jet air nozzles (20) in their rotating mountings are arranged circumferentially in this annular space, a spacer (28) is provided for the correct spacing of the jet air pipes (21) and the concentric pipes (16). It can also be clearly seen from FIG. 5 that in the annular cooling air space between the burner housing pipe (19) and the coal dust pipe (16), at least some of the gaps between neighboring jet air pipes (21) can be used for the installation of a pipe (18) for the supply of an alternative fuel and/or devices for monitoring the burner flame.

In the case of the burner described by the invention, different pressure levels can be set for the jet air, the spin air and cooling air. At every setting of the jet air nozzles (20), adequate flame stability can be ensured by maintaining the radial inner spin-air channel. There also exists the possibility of supplying a combustible gas through at least some of the jet air pipes and jet air nozzles instead of primary air.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A burner for a rotary tubular kiln with an annular channel arranged within a burner housing pipe for pneumatic transport and blowing out of fine-grained solid fuel through an annular gap nozzle, and with a number of jet air nozzles arranged concentrically around a circumference of the annular gap nozzle with nozzle openings divergent to a burner axis, through which combustion air is emitted, divided into a large number of separate, individual high-speed primary air jets, comprising:

a) the jet air nozzles with nozzle openings divergent to the burner axis being attached at an end of jet air pipes, which are jet air pipes arranged with their individual axes parallel to and spaced from the burner axis, b) the jet air pipes being arranged within an annular cooling air channel surrounding the solid fuel annular channel enclosed to an outside by the burner housing pipe, and being mounted at rotating mounting points so that each of the jet air pipes is rotatable around their individual jet air pipe axes while remaining parallel to the burner axis, c) the rotating mounting points of the jet air pipes being held in two spaced flange rings of the burner housing pipe, and d) a device for rotary adjustment of the jet air pipes being arranged outside the burner housing pipe at a cold end of the burner lance.

2. A burner in accordance with claim 1, wherein the annular chamber between the two spaced flange rings within the burner housing pipe equipped with a jet air feed pipe is designed as a flow chamber, from which supplied jet air flows through holes in the jet air pipes into the pipes themselves and then out through the jet air nozzles.

3. A burner in accordance with claim 1, wherein flexible hoses for jet air supply to the jet air pipes are connected the jet air pipes at their outer ends away from the jet air nozzles.

4. A burner in accordance with claim 1, wherein the burner housing pipe is equipped with a cooling air supply pipe, through which cooling air flows into the annular chamber between the burner housing pipe and the solid fuel pipe, where under the flow created by the jet air pipes it cools the burner housing pipe from the inside, before leaving the annular chamber through gaps between neighboring jet air nozzles.

5. A burner in accordance with claim 1, wherein an annular spacer is provided in the annular cooling air channel between the burner housing pipe and the solid fuel pipe, through which the cooling air can flow, which ensures a correct spacing of the jet air pipes and concentric pipes forming the annular solid fuel channel.

6. A burner in accordance with claim 1, wherein the annular cooling air space between the burner housing pipe and the solid fuel pipe, at least one of the gaps between neighboring jet air pipes can be used for the installation of a pipe for the supply of an alternative fuel.

7. A burner in accordance with claim 1, wherein as a means of rotary adjustment of the jet air pipes, these are equipped with pinions at their outer ends, which engage in one of a ring and belt and linked chain with internal teeth.

8. A burner for a rotary tubular kiln, comprising:

a burner housing pipe extending along a burner axis, an annular channel arranged within the burner housing pipe for the pneumatic transport and blowing out of fine-grained solid fuel through an annular gap nozzle, a plurality of jet air nozzles arranged concentrically around a circumference of the annular gap nozzle with nozzle openings divergent to the burner axis, through which combustion air is emitted, the jet air nozzles being divided into a plurality of separate, individual high-speed primary air jets, the jet air nozzles being attached at the end of jet air pipes, which pipes are arranged with their individual axes parallel to the burner axis and spaced therefrom, the jet air pipes being arranged within an annular cooling air channel surrounding the solid fuel annular channel enclosed to the outside by the burner housing pipe, and being mounted so that they can each rotate around their individual jet air pipe axes while remaining parallel to the burner axis, rotating mounting points of the jet air pipes being held in two spaced flange rings of the burner housing pipe, and a device for rotary adjustment of the jet air pipes being arranged outside the burner housing pipe at a cold end of the burner lance.

9. A burner in accordance with claim 8, wherein an annular chamber between the two spaced flange rings within the burner housing pipe comprises a low chamber, from which supplied jet air flows through holes in the jet air pipes into the pipes themselves and then out through the jet air nozzles.

10. A burner in accordance with claim 8, wherein flexible hoses for jet air supply to the jet air pipes are connected the jet air pipes at outer ends of the jet air pipes away from the jet air nozzles.

11. A burner in accordance with claim 8, wherein the burner housing pipe is equipped with a cooling air supply pipe, through which cooling air flows into the annular chamber between the burner housing pipe and the solid fuel pipe, where under the flow created by the jet air pipes the cooling air cools the burner housing pipe from the inside, before leaving the annular chamber through gaps between neighboring jet air nozzles.

12. A burner in accordance with claim 8, wherein an annular spacer is provided in the annular cooling air channel between the burner housing pipe and the solid fuel pipe, through which the cooling air can flow, which ensures a correct spacing of the jet air pipes and concentric pipes forming the annular solid fuel channel.

13. A burner in accordance with claim 8, wherein in the annular cooling air space between the burner housing pipe and the solid fuel pipe, at least one of the gaps between neighboring jet air pipes can be used for the installation of a pipe for the supply of an alternative fuel.

14. A burner in accordance with claim 8, wherein as a means of rotary adjustment of the jet air pipes, these are equipped with pinions at their outer ends, which engage in one of a ring and belt and linked chain with internal teeth.

* * * * *